US008792660B2

(12) United States Patent
Spieler et al.

(10) Patent No.: US 8,792,660 B2
(45) Date of Patent: Jul. 29, 2014

(54) HEARING SYSTEM WITH ANALOGUE CONTROL ELEMENT

(75) Inventors: Ivo Spieler, Kusnacht (CH); Lukas Erni, Zurich (CH); Andi Vonlanthen, Oberrohrdorf (CH)

(73) Assignee: Phonak AG, Stafa (CH)

( * ) Notice: Subject to any disclaimer, the term of this patent is extended or adjusted under 35 U.S.C. 154(b) by 26 days.

(21) Appl. No.: 13/501,285

(22) PCT Filed: Oct. 15, 2009

(86) PCT No.: PCT/EP2009/063445

§ 371 (c)(1),
(2), (4) Date: Apr. 11, 2012

(87) PCT Pub. No.: WO2009/156523

PCT Pub. Date: Dec. 30, 2009

(65) Prior Publication Data

US 2012/0201407 A1 Aug. 9, 2012

(51) Int. Cl.
*H04R 25/00* (2006.01)

(52) U.S. Cl.
CPC ..... *H04R 25/502* (2013.01); *H04R 2225/61* (2013.01); *H01H 2300/054* (2013.01)
USPC ..... 381/314; 381/109

(58) Field of Classification Search
CPC .. H04R 2225/61; H04R 25/502; H04R 25/70; H01H 2300/054; H01H 19/11
USPC ..... 381/109, 312–331, 60, 104
See application file for complete search history.

(56) References Cited

U.S. PATENT DOCUMENTS

| | | | | |
|---|---|---|---|---|
| 5,592,079 | A * | 1/1997 | Scheel | 324/207.25 |
| 6,748,089 | B1 * | 6/2004 | Harris et al. | 381/107 |
| 7,184,564 | B2 * | 2/2007 | Rosenthal | 381/322 |
| 7,634,097 | B2 * | 12/2009 | Niederdrank | 381/315 |
| 7,668,328 | B2 * | 2/2010 | Rosenthal et al. | 381/329 |
| 2002/0037087 | A1 | 3/2002 | Allegro et al. | |
| 2004/0240693 | A1 | 12/2004 | Rosenthal | |
| 2009/0003636 | A1 * | 1/2009 | Heuermann et al. | 381/312 |
| 2009/0129618 | A1 | 5/2009 | Heerlein et al. | |
| 2009/0196448 | A1 | 8/2009 | Schumaier | |

FOREIGN PATENT DOCUMENTS

WO 94/05965 A1 3/1994

OTHER PUBLICATIONS

International Search Report for PCT/EP2009/063445 dated Dec. 8, 2009.
Written Opinion for PCT/EP2009/063445 dated Dec. 8, 2009.

* cited by examiner

*Primary Examiner* — Curtis Kuntz
*Assistant Examiner* — Joshua A Kaufman
(74) *Attorney, Agent, or Firm* — Pearne & Gordon LLP

(57) ABSTRACT

A hearing system with an analogue control element including a selector for precise and reliable user selection of desired predefined settings. The selecting range of the analogue control element is partitioned into segments, each identified by an identification digit. At least two successive segments define a section. Each section represents a particular setting of the hearing system and is identified by a section digit. The hearing system stores the identification digit and the section digit in the non volatile memory according to the position of the selector. The stored identification digit and section digit are controlled by the signal processing unit and are only modified when the position of the selector is moved over at least two successive segments of the selecting range.

6 Claims, 3 Drawing Sheets

Fig. 5

| Step | Position |
|---|---|
| 1 | 1 |
| 2 | 1 |
| 3 | 1 |
| 4 | 1 |
| 5 | 1 |
| 6 | 2 |
| 7 | 2 |
| 8 | 2 |
| 9 | 2 |
| 10 | 2 |
| 11 | 3 |
| 12 | 3 |
| 13 | 3 |
| 14 | 3 |
| 15 | 4 |
| 16 | 4 |
| 17 | 4 |
| 18 | 4 |

HEARING SYSTEM WITH ANALOGUE CONTROL ELEMENT

TECHNICAL FIELD

The present invention is directed to a hearing system according to the preamble of claim 1.

BACKGROUND OF THE INVENTION

Hearing devices usually comprise control elements in order that the hearing device user is able to adjust parameter settings i.e. controlling the input/output behavior of the hearing device. Thereto, the control element is positioned on the hearing device housing for easy access by the user of the hearing device.

Analogue control elements, e.g. wheels, are commonly used as control element of analogue hearing instruments. As an analogue wheel provides a direct visual feedback of its position to the user of the hearing device, it is used as well for digital hearing devices. The absolute position of the wheel is mapped into discrete steps for digital devices.

This mapping of the position of the wheel contains the risk of faulty results due to minor deviations caused by e.g. temperature differences, humidity and vibrations. This problem especially occurs for so called borderline positions of the wheel, e.g. for positions just at the change of two discrete position mappings.

SUMMARY OF THE INVENTION

It is an object of the present invention to provide a hearing system with a reliable and precise analogue control element for selecting predefined settings of the hearing system.

Therefore, a hearing system is provided, comprising:

- a hearing device with a signal processing unit;
- at least one analogue control element with a selector with a mechanical delimited selecting range for selecting at least one particular setting of the hearing system,
  - each setting controlling one or multiple parameters of the hearing device,
  - the analogue control element being operatively connected to the signal processing unit,
  - the selecting range of the analogue control element being partitioned into discrete segments, each identified by a distinctive identification digit,
  - at least two successive segments defining a section, each section identified by a distinctive section digit;
  - each section representing a particular setting of the hearing system;
- a non volatile memory (NVM) unit section storing the identification digit and the respective section digit according to the position of the selector, said storing being controlled by the signal processing unit;
- the signal processing unit only modifying the identification digit and the section digit in the non volatile memory (NVM) unit section when the position of the selector is moved over at least two successive segments of the selecting range.

Thus it is possible for a user of the digital hearing device to reliably select a desired setting of the hearing system by selecting the setting out of a range of several settings by putting the selector to the predefined position within its selecting range. If the selector is moved only a short distance accidentally or due to external circumstances, the setting of the hearing system will not change as the section digit will not change and thus the movement will not have any influence on the actual setting of the hearing system.

If the selector is periodically moved back and forth only between two successive segments within the selecting range of the analogue control element, i.e. by vibrations or other external circumstances, the setting of the hearing system will not change but remain on its originally selected state.

In one embodiment of the present invention, the hearing system is further characterized in that the signal processing unit is operatively connected to said non volatile memory (NVM) unit section. The position of the selector of the analogue control element is mapped as two data values into a non volatile memory unit section, one value being the distinctive identification digit representing its position in a defined segment of the selecting range of the selector, the other value representing the section digit for the selected setting of the hearing system. Those values remain stored even after shutting down the digital hearing system and may be retrieved after a restart or reboot of the system.

In another embodiment, the haring system is further characterized in that at least one selector of the control element is a wheel. A wheel as selector provides an easy usability for the user of the hearing system both in form of a pivotable wheel only partly protruding out of the casing or as a flat wheel with a central slit to be operated by use of a screw driver or flat tool. The wheel may have printed or engraved position indicators and having a labeling along its selecting range indicating the respective selectable settings of the hearing system.

In a further embodiment, the hearing system is characterized in that three or more successive segments are defining a section.

In a further embodiment, the hearing system is characterized in that the connection between the analogue control element and the signal processing unit comprises an analogue-digital converting unit converting the analogue position signal of the analogue control element into a distinctive identification digit.

In a further embodiment of the invention, the hearing system is characterized in that a first movement of the selector activates a time trigger for a defined time period, during said time period any additional movement of the selector resulting in a change of the actual distinctive identification digit will be compared to the stored value within the non volatile memory unit section, and a new value will be stored into the non volatile memory unit section only if the actual and stored identification digit values differ more than one successive digit value.

It is expressly pointed out that any combination of the above-mentioned or hereinafter described embodiments is feasible. Of course, those combinations of embodiments that would result in contradictions are excluded.

Additional features of the present invention will become apparent by those skilled in the art upon consideration of the following detailed description of embodiments.

DESCRIPTION OF THE DRAWINGS

For purpose of facilitating and understanding of the invention, a preferred embodiment thereof is illustrated in the accompanying drawings to be considered in connection with the following description. Thus the invention may be readily understood and appreciated.

FIG. 5 is an exemplary mapping table of the control element according to FIG. 1.

DETAILED DESCRIPTION OF EMBODIMENTS OF THE INVENTION

Figure 1:
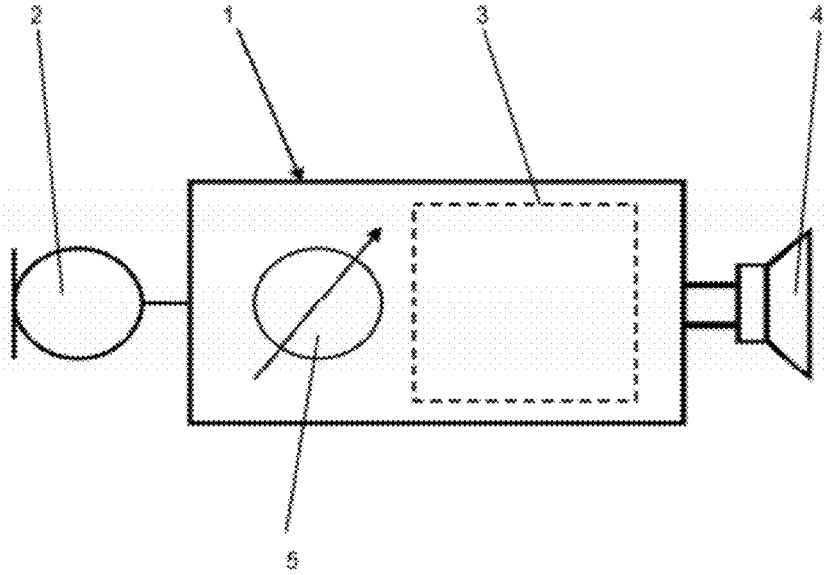
FIG. 1 is a schematic block diagram of a digital hearing system with an analogue control element.

The hearing system represented in FIG. 1 as a block diagram comprises a hearing device 1 to be inserted into the left or the right ear, respectively, of a hearing device user. The hearing device 1 comprises a microphone 2, a signal processing unit 3 and a loudspeaker 4 which is often called receiver in the technical field of hearing systems. As it is commonly known, the microphone 2 picks up sound that is processed in the signal processing unit 3. The processing of the sound is dependent on a hearing loss of the hearing device user and can be described by a transfer function having a number of parameters to be defined. The parameters are defined either concurrently with the occurrence of a certain acoustic surround situation, or are defined in advance based on the hearing loss only, for example. It is pointed out that the identification of the momentary acoustic situation and the automatic adjustment of a hearing program or set of parameters, respectively, belonging to the identified surround situation, can basically be done as has been already described in WO-A-01/20 965 and US-A-2002/037087 of the same applicant.

The sound picked-up by the microphone 2 is processed by the signal processing unit 3 and fed to the loudspeaker or receiver 4.

Furthermore, the hearing device 1 comprises a control element 5 in the form of an analogue control element comprising for example a wheel as selector. Basically, the control element 5 allows the hearing device user to adjust a particular setting of one or multiple parameters of the signal processing unit 3.

Usually, the changing of the setting by the control element is confirmed by an acoustic feedback through receiver 4 to the user, e.g. by a beep acknowledge or the like. It should be avoided that such a confirmation is played multiple times without any user operation due to a short movement or deviation of the control element from its selected position, e.g. caused by external influences like temperature or humidity change or by vibrations. Therefore, the present invention reliably prevents any unintentional changing of the setting of the hearing setting.

Figure 2:
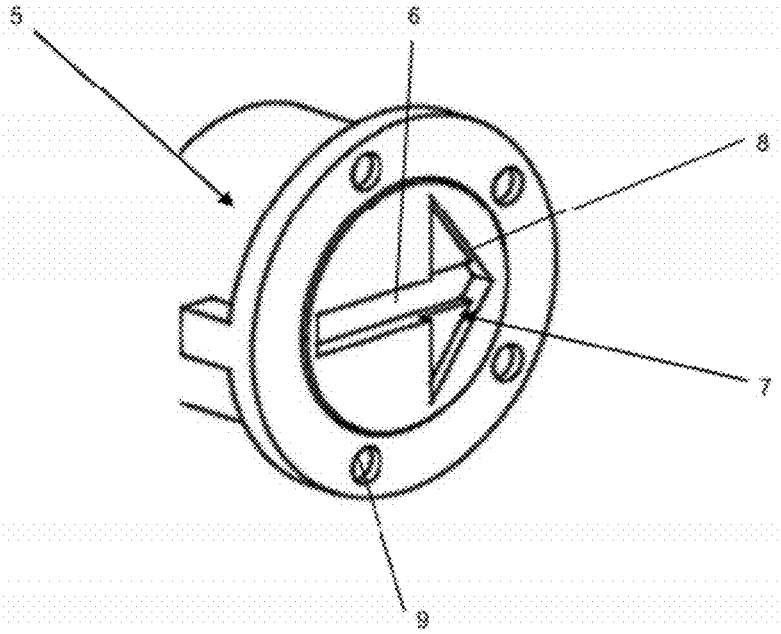
FIG. 2 is a schematically perspective view of an analogue control element of a hearing device according to the present invention.

FIG. 2 represents the schematically perspective view of an analogue control element 5 according to the present invention with a wheel 6 as selector. A slit 7 is arranged in the outer surface of the wheel 6 for turning it into its desired position. An arrow 8 is printed or engraved in the surface of the wheel 6 as position indicator. At the outer circumference around the wheel 6, a labeling or marking 9 is arranged according to the selectable settings of the hearing system. The hearing system is described comprising a hearing device 1 (as depicted in FIG. 1) with a signal processing unit 3 (as depicted in FIG. 1) and at least one analogue control element 5 with the selector 6 with a delimited selecting range for selecting at least one particular setting of the hearing system. Each setting controls one or multiple parameters of the hearing device 1, and the analogue control element 5 is operatively connected to the signal processing unit 3 (as depicted in FIG. 1).

Figure 3:
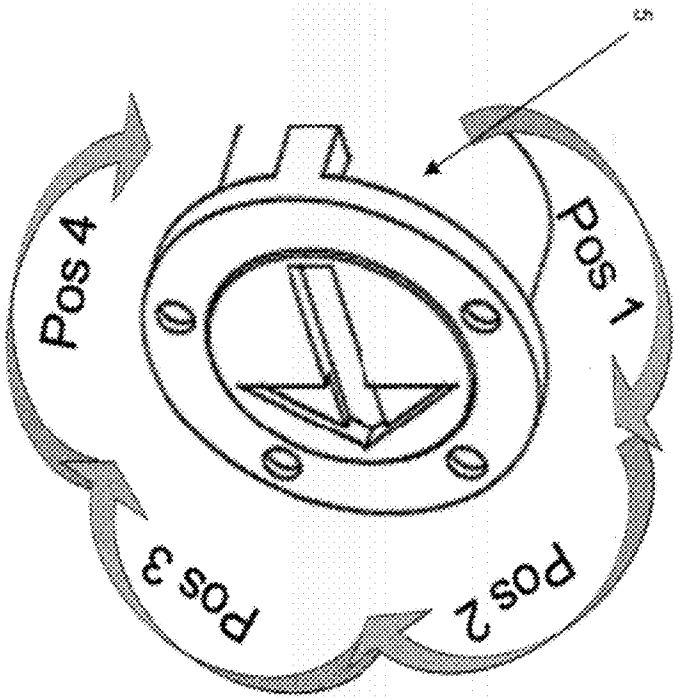
FIG. 3 is the perspective view according to FIGS. 1 and 2 with section indications.

FIG. 3 depicts the analogue control element 5 of FIGS. 1 and 2 with indications of the four selectable settings of this example. The settings are indicated as section Pos1 to section Pos4, therefore the section digits are 1 to 4. Each section represents a setting of one ore more parameters of the digital hearing system. By selecting one of the settings, the respective parameters will be loaded or set into the signal processing unit 3 of the hearing device 1.

Figure 4:
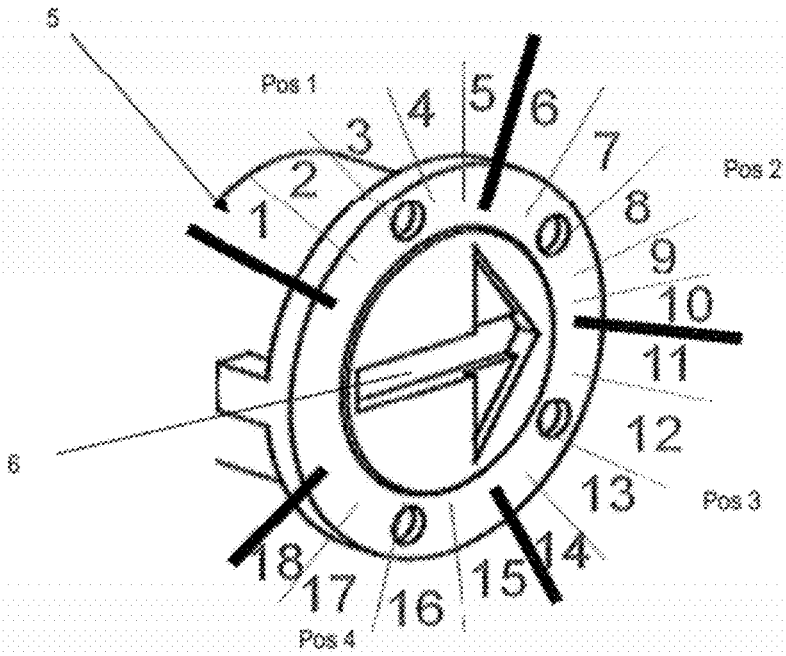
FIG. 4 is the perspective view according to FIG. 1 with segment indications.

For processing the position of the analogue control element 5 or the position of the selector 6 respectively, the delimited selecting range of the selector 6 is divided into a number of discrete segments, each having a distinctive, successive identification digit as reference, as depicted in FIG. 4. Furthermore, the selecting range of the analogue control element 5 is partitioned into discrete segments, for example into 18 digits (as depicted in FIG. 4), each identified by a distinctive identification digit, and at least two successive segments define a section Pos 1, . . . , Pos 4, each section is identified by a distinctive section digit; wherein each section Pos 1, . . . , Pos 4 represents a particular setting of the hearing system. Furthermore a non volatile memory NVM unit section (not shown in FIG. 4) is provided storing the identification digit and the respective section digit according to the position of the selector 6, said storing being controlled by the signal processing unit 3 (as depicted in FIG. 1) and the signal processing unit 3 is only modifying the stored identification digit and the section digit in the non volatile memory NVM unit section when the position of the selector 6 is moved over at least two successive segments of the selecting range.

The transformation of the analogue position signal of analogue control element 5 into a digital signal, e.g. a digit, may be performed by an analogue-digital converter, either within the signal processing unit 3 or by a separate analogue-digital converter connecting the analogue control element 5 with the signal processing unit 3.

By use of a mapping table depicted in FIG. 5, each identification digit is assigned to one of the section digits. The identification digit is labeled step and the section digit is labeled position in FIG. 5. Thus, by reading the identification digit, the signal processing unit 3 may read out of the mapping table the respective section digit. If this section digit would now be directly used as indication for changing the setting of the hearing system, already slight unintended movements of the selector 6 from its actual position, e.g. from its position in segment 10 to a position in the successive segment 11, would cause a changing of the setting of the hearing device. If this movement would be a back and forth movement, caused for instance by vibrations or other external influences, a permanent switching of the settings of the hearing system would be the result, thereby disturbing or annoying the user of the hearing system.

It is clear for a person skilled in the art that mapping of the position of the selector 6 of the analogue control element 5 may be performed by a predefined stored look-up table of FIG. 5 or by a calculation with a formula. The look-up table may be stored in a non volatile memory (NVM) unit to be altered during a fitting process of the hearing system. This non volatile memory (NVM) unit may be incorporated within the signal processing unit 3 or may be a separate unit connected to the signal processing unit 3.

To prevent any unintentional switching of the setting of the hearing system, the signal processing unit 3 will use only stored values in the non volatile memory module (NVM) section for selecting or switching the setting of the hearing system. Furthermore, only a movement over more than one successive segment will trigger a storing process of the new segment identification digit together with its related section digit. For instance, the selector will have to be moved from segment 10 to segment 12 until the new values will be stored and thus the setting will be switched by the signal processing unit 3 from setting Pos 2 to setting Pos 3.

The number of segments to be moved over before a new value will be stored into the non volatile memory (NVM) unit may be predefined and is called deviation. The deviation may be a constant value or be stored as well in the non volatile memory (NVM) unit and thus be subject to alteration or may even be dependent of the position of the selector 6 of the control element 5. It is thus possible to define different deviations for different segments of the control element 5, thus having different responsiveness for each segment.

A minimum value of 2 is required as deviation for achieving the desired result, any value above may be used as well, depending of the selecting range of the control element 5 and the number of selectable settings within this selecting range and the desired responsiveness.

An additional time trigger may be used together with the deviation for the analysis of the movement of the selector 6 of the control element 5.

Furthermore, after a reboot of the system, the stored value in the non volatile memory (NVM) unit will be used to select the hearing system setting. Only if the actual position of the selector 6 of the control element 5 differs more than the predefined deviation, the new values will be written into the non volatile memory (NVM) unit and then used for confirming or changing the setting of the hearing system.

What is claimed is:

1. A hearing system comprising:

a hearing device (1) with a signal processing unit (3);

at least one analogue control element (5) with a selector (6) with a delimited selecting range for selecting at least one particular setting of the hearing system, each setting controlling one or multiple parameters of the hearing device (1), the analogue control element (5) being operatively connected to the signal processing unit (3), the selecting range of the analogue control element (5) being partitioned into discrete segments, each identified by a distinctive identification digit, at least two successive segments defining a section (Pos 1, . . . , Pos 4), each section identified by a distinctive section digit;

each section (Pos 1, . . . , Pos 4) representing a particular setting of the hearing system;

a non volatile memory (NVM) unit section storing the identification digit and the respective section digit according to the position of the selector (6), said storing being controlled by the signal processing unit (3);

the signal processing unit (3) only modifying the stored identification digit and the section digit in the non volatile memory (NVM) unit section when the position of the selector (6) is moved over at least two successive segments of the selecting range;

wherein said hearing system is arranged such that a first movement of the selector (6) activates a time trigger for a defined time period, during said time period any additional movement of the selector (6) resulting in a change of the actual distinctive identification digit will be compared to the stored value within the non volatile memory (NVM) unit section, and a new value will be stored into the non volatile memory (NVM) unit section only if the actual and stored identification digit values differ more than one successive digit value.

2. Hearing system according to claim 1 characterized in that the signal processing unit (3) being operatively connected to said non volatile memory (NVM) unit section or the non volatile memory (NVM) unit section being integrated within the signal processing unit (3).

3. Hearing system according to claim 1 or 2, characterized in that at least one selector (6) of the control element (5) is a wheel.

4. Hearing system according to claim 1 or 2, characterized in that three or more successive segments defining a section.

5. Hearing system according to claim 1 or 2, characterized in that the connection between the analogue control element (5) and the signal processing unit (3) comprises an analogue-digital converting unit arranged to convert the analogue position signal of the analogue control element (5) into a distinctive identification digit.

6. Hearing system according to claim 1 characterized in that the selector (6) has a mechanical delimited selecting range.

* * * * *